United States Patent [19]

Miller et al.

[11] 4,163,531

[45] Aug. 7, 1979

[54] COIL WINDING APPARATUS

[75] Inventors: Imrich Miller, Paterson; Lothar Freimuth, Ringwood, both of N.J.

[73] Assignee: Universal Manufacturing Corporation, Paterson, N.J.

[21] Appl. No.: 849,784

[22] Filed: Nov. 9, 1977

[51] Int. Cl.[2] ..... B65H 54/30

[52] U.S. Cl. ..... 242/158 R; 242/158.4 R

[58] Field of Search ..... 242/158 R, 158.4 R, 242/25 R, 7.14, 7.15

[56] References Cited

U.S. PATENT DOCUMENTS

| | | | |
|---|---|---|---|
| 2,539,667 | 1/1951 | King | 242/158.4 R |
| 2,987,268 | 6/1961 | Haugwitz | 242/158.4 R |
| 3,259,336 | 7/1966 | Hibbard | 242/158 R |
| 3,370,808 | 2/1968 | Cox et al. | 242/158.4 R |
| 3,719,333 | 3/1973 | Kubo | 242/158.4 R |

FOREIGN PATENT DOCUMENTS

| | | | |
|---|---|---|---|
| 922924 | 1/1955 | Fed. Rep. of Germany | 242/158 R |
| 1023720 | 12/1952 | France | 242/158 R |

*Primary Examiner*—Stanley N. Gilreath
*Attorney, Agent, or Firm*—Darby & Darby

[57] ABSTRACT

Apparatus for winding coils of wire on a bobbin is disclosed. The coil winding apparatus comprises a support structure, a drive shaft arranged for axial rotation carried by the support structure, a carriage carried by the support structure, the carriage being arranged for movement in a plane parallel to the axis of rotation of the drive shaft, the carriage including a wire feed guide arranged to pivot about an axis perpendicular to the axis of rotation of the drive shaft and spring means connected to the guide for regulating the pivoting of the guide. A drive wheel coupled to the carriage is in rotational tangential contact with the drive shaft, with the rotational axes of the drive wheel and drive shaft being offset in a direction opposite to the direction of rotation of the drive shaft and drive wheel at their point of tangency, the axes of rotation of the drive wheel and the drive shaft forming an angle, whereby the rotation of the drive wheel causes the movement of the carriage.

15 Claims, 4 Drawing Figures

FIG. 3
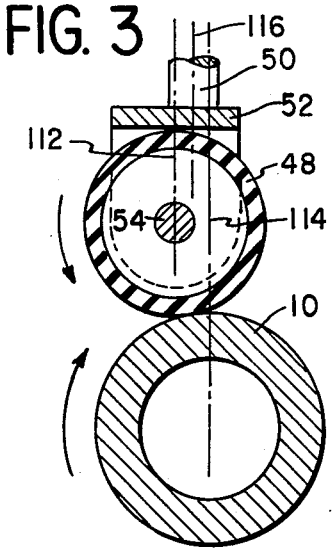
FIG. 1
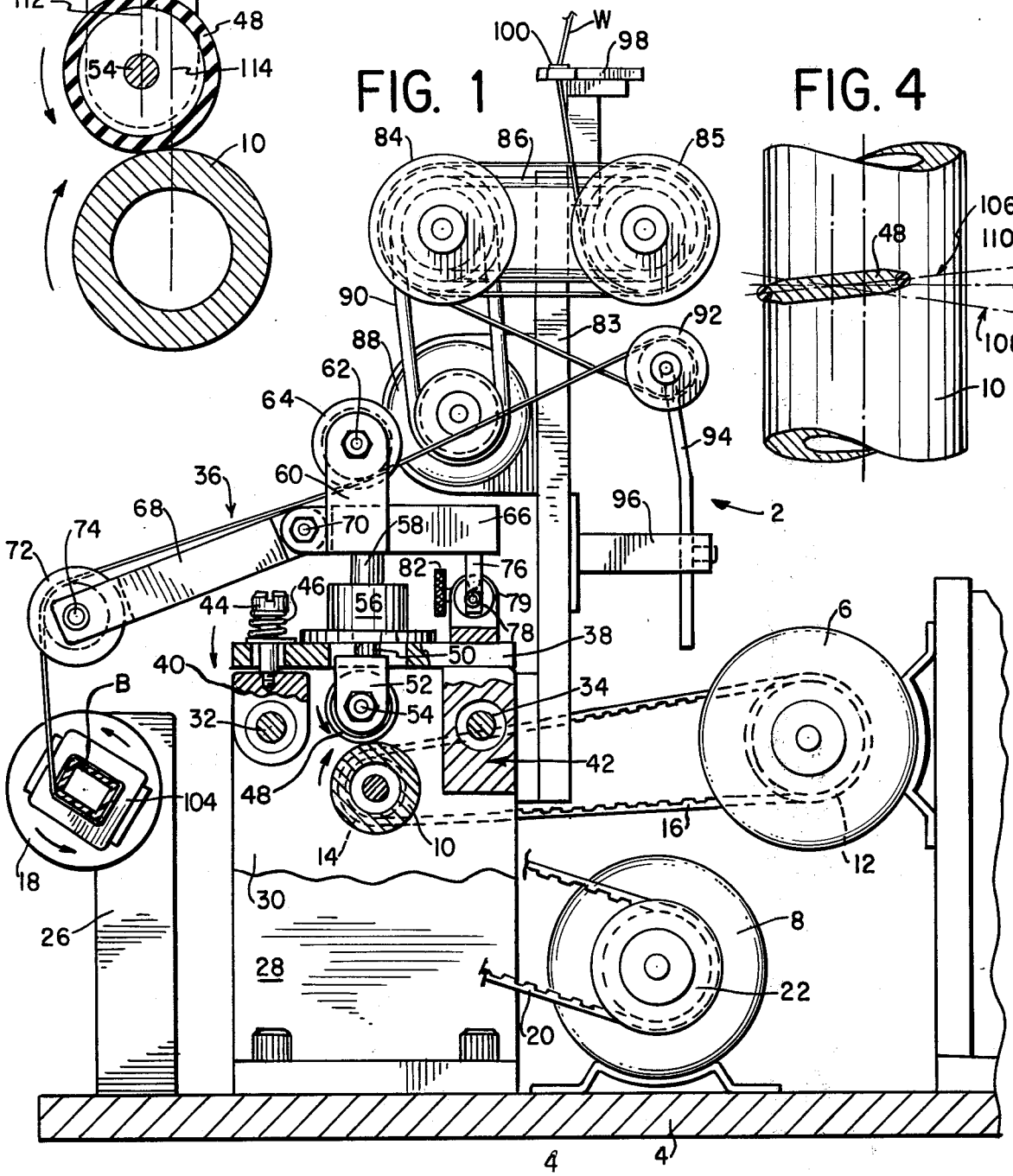
FIG. 4

COIL WINDING APPARATUS

BACKGROUND OF THE INVENTION

This invention relates to apparatus for winding coils of wire on a bobbin and more particular to such an apparatus which coils wire on a bobbin in a smooth, tight, helix.

Apparatus for winding winds of wire on a coil in the form of a bobbin are well known in the art. It is also well known that it is desirable that such devices lay the wire on a bobbin in a transverse direction as well as rotationally, so that the wire is coiled helically rather than spirally. An example of a device which accomplishes the desired function is disclosed in U.S. Pat. No. 3,719,333. Devices of the type illustrated by the cited patent suffer, however, from the defect that they are substantially inefficient in providing the required transversely directed motive force to the transversely movable carriage portion of the winding apparatus. This results in both an undesirable waste of energy and, to some degree, defectively wound coils in that there is a substantial likelihood that consecutive turns of the wire of a layer of the coil will overlie one another rather than being adjacent to one another in the same plane.

SUMMARY OF THE INVENTION

It is, therefore, an important object of the present invention to provide an improved coil winding apparatus having a construction such that the aforesaid drawbacks and disadvantages may be most efficaciously avoided.

It is a further object of this invention to provide such an apparatus which is more efficient than presently known devices with respect to the energy utilized.

It is still another object of the invention to provide such an apparatus which provides a smooth, tightly wrapped, helically wound coil.

Generally speaking, the objectives of the present invention are attained by the provision of a coil winding apparatus comprising support means, a drive shaft arranged for axial rotation carried by the support means, carriage means carried on the support means, the carriage means being arranged for movement in a direction parallel to the axis of rotation of the drive shaft, and a drive wheel coupled to the carriage means in rotational tangential contact with the drive shaft, the vertical plane in which the centerline of the drive wheel lies being off-set from the vertical plane in which the centerline of the drive shaft lies in a direction opposite to the direction of rotation of the drive shaft and drive wheel at their point of tangential contact.

BRIEF DESCRIPTION OF THE DRAWINGS

The foregoing and other objects and features of the present invention will be more clearly understood from the following detailed description thereof when read in conjunction with the accompanying drawings in which:

FIG. 1 is a cross-sectional plan view of the inventive apparatus;

FIG. 3 is a cross-sectional plan view illustrating the relative positions of the drive wheel and drive shaft of the inventive apparatus; and FIG. 4 is a detailed top view of the wheel and shaft illustrated in FIG. 3.

DESCRIPTION OF THE PREFERRED EMBODIMENT

Figure 2:
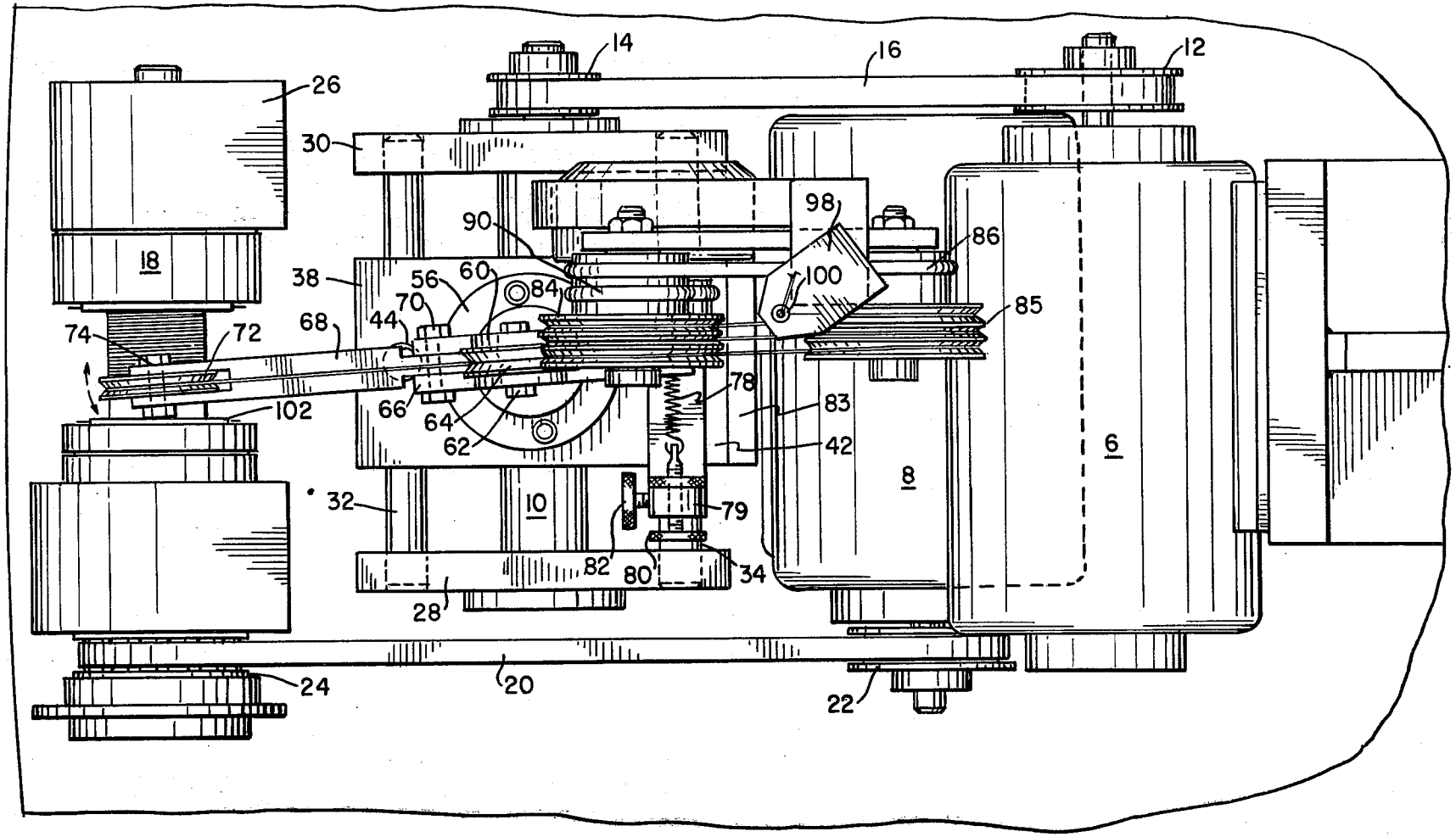
FIG. 2 is a top view of the apparatus.

Turning first to FIG. 1, there is illustrated a cross-sectional plan view of the coil winding apparatus indicated generally at 2. A frame or support member 4 carries a drive motor 6 and a bobbin rotating motor 8. The drive motor 6 rotates a drive shaft 10 through pulleys 12 and 14, mounted on motor 6 and drive shaft 10, respectively, which pulleys are connected by a belt 16. Bobbin rotating motor 8 rotates a bobbin drive 18 by means of a belt 20 connected between a pulley 22 mounted on the output shaft of motor 8 and a pulley 24 (FIG. 2) on the bobbin drive 18. Although the drive shaft 10 and the bobbin drive 18 have been illustrated as being driven by individual motors, it will be understood the alternative modes of drive may be provided, for example, both may be driven by the same motor through appropriate gears and/or pulleys.

The bobbin drive 18 is illustrated as being mounted on the support 4 by a rigid bracket 26, although of course, it may be completely separated from the support. It is preferred that, for the purpose of reducing friction, the drive shaft 10 be mounted on the support 4 by suitable bearings (not shown) carried by plates or brackets 28 and 30 which are mounted on the support 4. Also mounted between the brackets 28 and 30 are a pair of carriage bearing shafts 32 and 34. A carriage, indicated generally at 36, is mounted on and adapted to move along the shafts 32 and 34. Carriage 36 includes a horizontally extending platform 38 and vertically downwardly extending front and rear end pieces 40 and 42. The rear end piece 42 may be integrally formed with the carriage platform 38 thereby forming an L-shape section. Alternatively, platform 38 and the rear end piece 42 may be formed separately and then connected together. The front end piece 40 preferably is formed separately from the platform 38 and the two are connected to one another by means of a screw 44 biased by a spring 46. The front and rear end pieces 40 and 42 each run for a substantial portion of the length of platform 38 of the carriage 36. Each has a hole through which the shafts 32 and 34, respectively, pass. This permits the carriage 38 to be traversed along the shafts 32, 34.

Carriage 36 also carries a drive wheel 48 which is mounted in a bracket 52 by an axle 54. Bracket 52 is in turn mounted on the lower end of a rotatable vertical shaft 50. The upper end of shaft 50 is received in a bearing 56 mounted on carriage platform 38.

Bearing 56 also carries the lower end of a rotatable shaft 58 which is an extension of shaft 50. Connected to the upper end of shaft 58 is a bracket 60 which carries a horizontal axle 62 on its upper end. A grooved pulley 64 is rotatably mounted on axle 62 in bracket 60. A beam 66 the major portion of which extends rearwardly is fixedly connected to the lower end of bracket 60. The beam 66 swings with the bracket 60 as shaft 58 rotates. A guide arm 68 is connected to the beam 66 by any conventional means, such as a nut and bolt 70. Guide arm 68 is angled downwardly from the beam 66 and the end of guide arm 68 remote from beam 66 carries a shaft 74 on which a grooved pulley 72 is mounted for rotation. It is thus seen that pulley 64, beam 66, guide arm 68 and pulley 72 are all mounted as a unit on the vertical shaft 58 and that this unit is freely rotatable with shaft 58 on the horizontal platform 38 of carriage 36.

A downwardly extending vertical extension piece 76 is connected to the rear end of beam 66 and extends below the beam. One end of a respective horizontally extending spring 78, one of which is shown in FIG. 2, is connected to each side of piece 76. The other end of each spring 78 is connected to an adjustable mount 79 on a respective side of the carriage platform 38. Each of the adjusting mounts 79 includes a spring tension adjusting screw 80, and a set screw 82, the purpose of the latter of which is to lock the adjustable screw 80 to maintain the tension of the spring 78 as set.

Mounted to the rear wall 42 of carriage 36 is a vertical post 83 which carries a pair of pulleys 84 and 85 at its upper end. These two pulleys are coupled to one another by a pulley belt 86. An electromagnetic brake 88 is coupled to the pulley 84 by a belt 90. A dancer wheel 92 is mounted to one end of a spring rod 94 which in turn is connected to a horizontal extension 96 of the post 83. Also connected to post 83 is a plate 98 which has a wire guide eyelet or orifice 100 through which wire to be wound on the bobbin 13 enters the apparatus.

Referring to FIGS. 1, 2 and 4, the general operation of the apparatus is described. A wire, indicated at W, which is to be helically wound in a multi-layer about a bobbin 13 carried by bobbin drive 18*a*. The wire W, which may be fed from a storage reel (not shown), passes through the guide eyelet 100 in plate 98 then counterclockwise around pulley 85 and counterclockwise around pulley 84. Wire W passes under and in a counterclockwise direction around the dancer 92. It then passes under pulley 64, over the pulley 72 on the end of arm 68 and onto the driven bobbin. Wire W passes under pulley 64 and makes contact with that pulley only at a point of tangency. This point of tangency is below a straight line drawn from the wire exit point on dancer 92 and the wire entry point on pulley 72. The purpose of the offset of the tangent contact point on pulley 64 is to relieve tension on the wire and, also, to make the movement of the beam 66 substantially independent of forces on the wire between pulley 64 and dancer 92.

Pulleys 84 and 85 are coupled by the belt 86 and both of these pulleys are therefore under the control of the electro-magnetic brake 88 which is connected to pulley 84 by the belt 90. The brake 88 which uses a conventional circuit, for example, by sensing the torque of the bobbin drive shaft, controls the tension on the wire W. Thus, when wire is first brought to the bobbin 13 at the beginning of a coil winding sequence it is desirable that the pulleys 84 and 85 be more freely rotatable so that the wire may more easily be wound on the bobbin. However, as successive layers of wire are laid down on the bobbin during the coil winding process, the braking force applied by the magnetic brake 88 is incrased so that a greater force is required to draw the wire from its source. This insures that the wire remains taut while it is being wound on the bobbin. It will be noted that, in FIG. 1, the central part of the bobbin 13 on which wire W is wound is illustrated as a rectangular structure. The dancer 92,94 is provided to assist in keeping the wire taut as it is wound onto the bobbin.

The horizontal axis 62 of pulley 64 is offset from (shown in front of) the vertical axis of pivotable shaft 58. The purpose of this offset is to place the point of tangency of wire W with pulley 64 on an extension of the axis of the shaft 58. This avoids torsion on the shaft 58 caused by the tension in wire W.

Referring to FIG. 2, it is seen that the longitudinal axis of guide arm 68 lies in a vertical plane cutting the pulley 72, in which also lies the axis of shaft 58. The wire W being fed to the bobbin B lies in this vertical plane, hereafter called guide arm vertical plane. The guide arm vertical plane pivots, or swings is as bracket 66 turns with shaft 58 as coiling of the wire W proceeds from one of the bobbin flanges 102 to the other 104 and returns. The fact that the guide arm plane is not orthogonal relative to the axis of rotation of the bobbin 18 causes the axis of rotation of the carriage drive wheel 48 to form an angle relative to the axis of rotation of the drive shaft 10, as illustrated most clearly in FIG. 4. The carriage drive wheel 48, which can be made of a somewhat resilient material, such as hard rubber, is in frictional contact with the drive shaft 10, which can be made for example, of metal. Drive wheel 48 contacts with and is rotated by the rotatable shaft 10. Since the axes of rotation of the carriage drive wheel 48 and drive shaft 10 are at an angle, the contact between the two causes the carriage drive wheel to be rotated and moved transversely along the drive shaft 10, carrying carriage 36 along. The direction of skew of the guide arm plane which cuts through the center of drive wheel 48 and to which also the axis of rotation of drive wheel 48 is perpendicular, determines the direction of travel of the carriage with respect to drive shaft 10, which is always turning in the opposite direction to wheel 48. The combination of the screw 44, which is threaded into front end 40 of the carriage 36, and the spring 46 maintains the carriage drive wheel 48 and the drive shaft 10 in tangential contact with sufficient force to insure rotation of the wheel 48 upon rotation of the shaft 10. The carriage 36 will therefore be moved, by the drive wheel 48, along the bearing shafts 32 and 34.

As the bobbin B is rotated by motor 8, thereby drawing the wire W onto itself, the vertical guide arm plane tends to retain its non-orthogonal angular orientation relative to the axis of rotation of the bobbin. This would appear to tend to cause the wire to coil spirally on itself around the bobbin. However, the low coefficient of friction of the wire, in combination with the angular orientation of the aforesaid plane relative to the axis of rotation of the bobbin, and the driving action of carriage drive wheel 48, causes slippage of one turn of the wire over the immediately preceding turn. This results in subsequent turns of the coil being contiguous with, and in the same plane as, preceding turns, thereby providing the desired helically wound coils.

The slippage of one turn over a preceeding turn causes a momentary jogging of the assembly of the pulley 72, the guide arm 68, the pulley 64, the beam 66 and the pivotable shaft 58. The transverse movement of the carriage caused by drive wheel 48 being rotated by shift 10, however, causes the guide arm plane to return to its original angular orientation relative to the axis of rotation of the bobbin immediately after the slippage of each subsequent turn. The same angular orientation is substantially maintained as the carriage moves along during the winding of a layer of wire between the two flanges. The angle of the plane is never perpendicular to the axis of rotation of the bobbin.

The pair of transversely extending springs 78 are each tensioned to insure the balance of beam 66 and guide arm 68 assembly rotatably mounted on shaft 58 thereby insuring that the angular off-set initially provided to the longitudinal axis of the guide arm 68 relative to the axis of rotation of the bobbin 18 is maintained and that excessive "floppiness" does not occur each time the pivotable assembly is jogged.

The carriage 36 may be manually positioned at any location along the drive shaft 10. This is accomplished by grasping a lever arm 83 attached to the rear piece 42 of the carriage and moving it with sufficient force to overcome the force provided by the spring 46. Upon the application of such force, the wheel 48 is moved out of contact with the shaft 10 and the carriage is movable along the bearing shafts 32 and 34.

After completion of winding a coil layer, that is, after a layer of wire has been laid from one flange of the bobbin to the opposite flange, the wire W engages one of the end flanges of the bobbins. This causes the vertical guide arm plane to pivot to an angular orientation (relative to the axis of rotation of the drive shaft 10) which is symmetrical with, and opposite to, its former orientation. It should be understood that only a small amount of force is needed to move guide arm 68 to pivot wheel 48. This causes the carriage 36 to move transversely in a direction opposite to that formerly travelled and will result in the application of another layer of coiled wire to the bobbin 18. It will be understood of course that, guide arm 68, shaft 58 and the drive wheel 48 will continue to "jog" independent of the direction in which the carriage is moving. This reversal of drive wheel angular orientation is indicated most clearly in FIG. 4 where line 106 indicates the orientation of the vertical guide arm panel and drive wheel 48 relative to the drive shaft 10 when wire is being wound in a direction away from the flange 102 and toward the flange 104, whereas line 108 indicates the plane and drive wheel orientation from the flange 104 toward flange 102. For illustrative purposes, the orientation of the guide arm plane and of the drive wheel 48 in a condition where the axes of rotation of the wheel 48 and of the shaft 10 are parallel, is indicated at 110.

FIG. 3 illustrates the positioning orientations of the vertical shaft 50 carrying the guide arm assembly, the drive wheel 48 axis of rotation 54 and the axis of rotation of drive shaft 10. Vertical line 112, bisects and is transverse to the shaft 54 of drive wheel 48, while vertical line 114 bisects and is transverse to the axis of drive shaft 10. Vertical line 116 is the axis of rotation of shafts 50 and 58. It has been found that advantages are obtained if the axis 54 of the carriage drive wheel 48 is offset relative to the axis of drive shaft 10 rather than lying directly above it. In the preferred embodiment, the axis of the carriage drive wheel 48 is offset from that of the drive shaft 10 in a direction opposite to the direction of rotation of the wheel 48 and the shaft 10 (the directions of rotation being indicated by the arrows). The offset is also shown by the vertical lines 112 and 114. That is, line 112 lies in front of line 114. This provides an offset of the drive wheel and drive shaft at their point of tangency which results in an increase in rapidity and ease with which the drive wheel 48 pivots relative to the drive shaft 10, discussed above with regard to FIG. 4. The arrangement is superior to that obtainable when the axes of rotation of drive wheel 48 and the drive shaft 10 are aligned directly above one another.

It will also be seen that the vertical axis of rotation of the shaft 50, indicated at 116, lies between the lines 112 and 114. The location of the axis of rotation 116 between the lines 112 and 114 further enhances the capability of the drive wheel 48 to be angularly reoriented relative to the drive shaft 10 because of a lever action. This results since the axis 116 is not in line with either of the lines 112 or 114. In particular, it has been found that location of the axis of rotation 116 intermediate the lines 112 and 114 results in an arrangement where even a small force exerted on the pulley 72 in a direction parallel to the axis of rotation of the drive wheel 48 causes a very rapid angular reorientation or restoration of the drive wheel 48 relative to the axis of rotation of the drive shaft 10. The rapid angular reorientation of the drive wheel 48, which is due both to the offset of the axes of rotation of drive wheel 48 and drive shaft 10, and to the fact that the axis 116 is intermediate these axes, results in the smooth coiling and proper positioning of the wire onto the bobbin 18.

It will be understood that the foregoing description of the preferred embodiment of the present invention is for purposes of illustration only, and that the various structural and operational features as herein disclosed are susceptible to a number of modifications and changes none of which entail any departure from the spirit and scope of the present invention as defined in the hereto appended claims.

What is claimed is:

1. Coil winding apparatus for winding a wire on a bobbin comprising:

support means;

a drive shaft arranged for axial rotation carried by said support means; means for rotating said drive shaft in a first direction;

carriage means, means carried by said support means for guiding said carriage means for movement in a plane parallel to the axis of rotation of said drive shaft;

a drive wheel in rotational tangential contact with said drive shaft, a pivot shaft, means coupling said shaft to said carriage for pivotal motion with respect thereto and means coupling said drive wheel to said pivot shaft, means coupled to said shaft for supplying the wire to said bobbin, the axes of rotation of said drive wheel and said drive shaft forming an angle whereby the rotation of said drive wheel by said drive shaft causes the movement of said carriage means, the axis of rotation of said drive wheel being offset from the axis of rotation of said drive shaft in a direction opposite to the direction of roation of said drive shaft and drive wheel at their point of tangential contact.

2. Coil winding apparatus according to claim 1 wherein the axis of said pivot shaft is orthogonal to the axis of rotation of said drive shaft.

3. Coil winding apparatus according to claim 2 wherein the axis of said pivot shaft lies between the rotational axes of said drive wheel and said drive shaft.

4. Coil winding apparatus according to claim 2 wherein the axis of said pivot shaft is intermediate said drive wheel and said drive shaft axes.

5. Coil winding apparatus according to claim 1 wherein said carriage means further comprises force means for urging said drive wheel into contact with said drive shaft.

6. Coil winding apparatus according to claim 1 wherein said carriage guide means comprises bearing means for carrying said carriage means, and means for pivoting said carriage means about said bearing means for moving said drive wheel out of contact with said drive shaft.

7. Coil winding apparatus according to claim 1 wherein said wire supply means further comprises guide means, said guide means and the axis of said pivot shaft to which said guide means is coupled lying in a plane which is perpendicular to the axes of rotation of both said drive shaft and said drive wheel.

8. Coil winding apparatus according to claim 7 wherein said carriage means further comprises spring means connected to said guide means for damping the pivoting of said guide means.

9. Coil winding apparatus according to claim 7 wherein said wire supply means further comprises a guide wheel for the wire being wound, said guide wheel mounted to said guide means for movement therewith, the axis of rotation of said guide wheel being offset from the axis of rotation of said pivot shaft.

10. Coil winding apparatus according to claim 9 wherein the offset of said guide wheel is positioned to provide tangential contact to the wire being wound at a point lying along the axis of rotation of said pivot shaft.

11. Coil winding apparatus according to claim 9 wherein a vertical plane through the axis of rotation of said guide wheel is interjacent respective vertical planes through the axes of said drive wheel and said drive shaft.

12. Coil winding apparatus according to claim 2 wherein said wire supply means further comprises guide means, said guide means and the axis of said pivot shaft to which said guide means is coupled lying in a plane which is perpendicular to the axes of rotation of both said drive shaft and said drive wheel.

13. Coil winding apparatus to claim 12 wherein said wire supply means further comprises a guide wheel for guiding the wire being wound, said guide wheel mounted to said guide means for movement therewith, the axis of rotation of said guide wheel being offset from the axis of rotation of said pivot shaft.

14. Coil winding apparatus according to claim 13 wherein the offset of said guide wheel is positioned to provide tangential contact to the wire being wound at a point lying along the axis of rotation of said guide means pivot shaft.

15. Coil winding apparatus as in claim 14 wherein the guide means includes a first pulley over which the wire to be wound is fed from said guide wheel, said wire supply means also including a second pulley for feeding the wire to said guide wheel, the point of tangency of said wire with said guide wheel being offset from a straight line drawn between the tangent point of the wire with said first and second pulleys.

* * * * *